US006789528B2

(12) United States Patent
Endo

(10) Patent No.: US 6,789,528 B2
(45) Date of Patent: Sep. 14, 2004

(54) HIGH PRESSURE FUEL SUPPLY DEVICE HAVING PLATING LAYER AND MANUFACTURING METHOD THEREOF

(75) Inventor: Hisashi Endo, Obu (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/390,673

(22) Filed: Mar. 19, 2003

(65) Prior Publication Data

US 2003/0188715 A1 Oct. 9, 2003

(30) Foreign Application Priority Data

Apr. 5, 2002 (JP) ..... 2002-103402

(51) Int. Cl.[7] ..... F02M 55/02

(52) U.S. Cl. ..... 123/468; 123/456; 138/145; 29/890.129

(58) Field of Search ..... 123/468, 469, 123/470, 456; 29/890.128, 890.129; 285/133.4, 197, 189, 288.1, 382, 187, 386; 138/146, 141, 143, 145, 139, 172

(56) References Cited

U.S. PATENT DOCUMENTS 3,227,147 A * 1/1966 Gossiaux ..... 123/468
6,494,183 B2 12/2002 Usui et al.
6,584,959 B2 * 7/2003 Stieler ..... 123/468
6,609,502 B1 * 8/2003 Frank ..... 123/469
6,612,289 B1 * 9/2003 Frank et al. ..... 123/456
6,634,335 B2 * 10/2003 Boecking et al. ..... 123/456

FOREIGN PATENT DOCUMENTS

JP 2000-7390 3/2000
JP 2001-280218 10/2001

* cited by examiner

*Primary Examiner*—Carl S. Miller
(74) *Attorney, Agent, or Firm*—Nixon & Vanderhye PC

(57) ABSTRACT

In a pressure accumulator vessel of a high pressure fuel supply device, a chamfered section is formed in a connection between an accumulation chamber and a corresponding fuel passage. An inner plated part, which includes a plating layer, is formed along a wall surface of the accumulation chamber, a wall surface of the fuel passage and a wall surface of the chamfered section. The pressure accumulator vessel further includes connecting portions and sealing portions. The connecting portion is formed to join with a fuel pipe. The sealing portion is formed adjacent to the connecting portion to fluid-tightly engage with the fuel pipe. Each unplated part is formed along a wall surface of the corresponding connecting portion and a wall surface of the corresponding sealing portion.

15 Claims, 6 Drawing Sheets

HIGH PRESSURE FUEL SUPPLY DEVICE HAVING PLATING LAYER AND MANUFACTURING METHOD THEREOF

CROSS REFERENCE TO RELATED APPLICATION

This application is based on and incorporates herein by reference Japanese Patent Application No. 2002-103402 filed on Apr. 5, 2002.

BACKGROUND OF THE INVENTION

1. Field of the Invention

The present invention relates to a high pressure fuel supply device of a pressure accumulating type.

2. Description of Related Art

A high pressure fuel supply device of a pressure accumulating type has been proposed as a high pressure fuel supply device of, for example, a diesel engine. In the high pressure fuel supply device, high pressure fuel is accumulated in a pressurized state in a pressure accumulation chamber formed in a pressure accumulator vessel and is supplied to each corresponding fuel injection device. Fuel passages are also formed in the pressure accumulator vessel. Each fuel passage is communicated with the accumulation chamber and conducts fuel to the accumulation chamber or conducts fuel from the accumulation chamber. An axis of the accumulation chamber is generally perpendicular to an axis of each fuel passage. Thus, an edged corner is formed in a connection between the accumulation chamber and the corresponding fuel passage.

Lately, to meet a demand for improving exhaust gas purification and also a demand for improving combustion efficiency, it is required to increase fuel injection pressure to further atomize fuel mist.

However, when the pressure of fuel accumulated in the accumulation chamber is increased, stress, which is applied from the pressure of fuel in the accumulation chamber to the accumulator vessel, is disadvantageously increased. In the case where the edged corner is formed in the connection between the accumulation chamber and the corresponding fuel passage, the stress applied to the accumulator vessel is concentrated in the edged corner.

In Japanese Unexamined Patent Publication No. 2000-73908, in order to address the above disadvantage, for example, there has been proposed a high pressure fuel supply device, which has a pressure accumulator vessel that includes an inner member and an outer member. In this high pressure fuel supply device, the inner member is press fitted into the outer member to apply compressive pre-stress to the inner member to reduce tensile stress applied from the fuel in the accumulation chamber to the inner member. However, in the high pressure fuel supply device disclosed in Japanese Unexamined Patent Publication No. 2000-73908, since the accumulator vessel includes the outer member and the inner member, the number of components is disadvantageously increased, and the total manufacturing time of the high pressure fuel supply device is also disadvantageously increased.

Furthermore, there has been proposed another technique for chamfering the edged corner in the connection between the accumulation chamber and the fuel passage through an electrolytic process to avoid concentration of stress in the corner. In this case, the chamfered section, which is chamfered through the electrolytic process, has a rough surface, which likely causes localized concentration of stress in the chamfered section. To address this disadvantage, the surface of the corner is smoothed through an abrasive flow machining process applied to the interior of the accumulator vessel after each corner is chamfered thorough the electrolytic process. However, the abrasive flow machining process disadvantageously requires a relatively long processing time. Furthermore, when the abrasive flow machining process is performed, particles, which are generated upon abrasion of the accumulator vessel, or abrasive material, which is contained in the abrasive fluid, may be left as residual debris in the processed accumulator vessel. Thus, a delicate washing process is required after the abrasive flow machining process. This disadvantageously results in an increase in the processing time.

SUMMARY OF THE INVENTION

Thus, it is an objective of the present invention to provide a high pressure fuel supply device, which minimizes concentration of stress in an accumulator vessel of the high pressure fuel supply device and improves pressure resistivity of the accumulator vessel to improve reliability of the high pressure fuel supply device without increasing the number of components of the high pressure fuel supply device and without leaving an substantial amount of residual debris in the high pressure fuel supply device.

It is another objective of the present invention to provide a manufacturing method of a high pressure fuel supply device, which allows a reduction in a total processing time of the high pressure fuel supply device without leaving a substantial amount of residual debris in the high pressure fuel supply device.

To achieve the objectives of the present invention, there is provided a high pressure fuel supply device having a pressure accumulator vessel that includes a pressure accumulation chamber, a fuel passage and a chamfered section. The pressure accumulation chamber extends in an axial direction of the pressure accumulator vessel. The fuel passage fluidly communicates between the accumulation chamber and an outside of the pressure accumulator vessel. The chamfered section is formed in a connection between the accumulation chamber and the fuel passage. An inner plated part, which includes a plating layer, is formed along a wall surface of the accumulation chamber, a wall surface of the fuel passage and a wall surface of the chamfered section.

To achieve the objectives of the present invention, there is also provided a manufacturing method of a high pressure fuel supply device, to which an external fuel pipe is joined. In the method, an axial hole, a branched hole and a chamfered section are first formed in a bar member. The axial hole extends in an axial direction of the bar member. The branched hole fluidly communicates between the axial hole and an outside of the bar member. The chamfered section is formed in a connection between the axial hole and the branched hole. Then, a connecting portion and a sealing portion are formed in the bar member. The connecting portion is formed to join with the external fuel pipe in such a manner that the fuel pipe is securely held by the connecting portion and is fluidly communicated with the branched hole. The sealing portion is formed adjacent to the connecting portion to fluid-tightly engage with the fuel pipe. Thereafter, a removable sealing member is installed in the bar member in such a manner that the sealing member engages the connecting portion and the sealing portion to fluid-tightly separate the axial hole and the branched hole from the connecting portion and the sealing portion. Then, a plated part, which includes a plating layer, is formed along a wall surface of the axial hole, a wall surface of the branched hole and a wall surface of the chamfered section.

To achieve the objectives of the present invention, there is further provided a manufacturing method of a high pressure fuel supply device, to which an external fuel pipe is joined. In the method, an axial hole, a branched hole and a chamfered section are formed in a bar member. The axial hole extends in an axial direction of the bar member. The branched hole fluidly communicates between the axial hole and an outside of the bar member. The chamfered section is formed in a connection between the axial hole and the branched hole. Then, a plated part, which includes a plating layer, is formed along a wall surface of the axial hole, a wall surface of the branched hole and a wall surface of the chamfered section. Thereafter, a connecting portion and a sealing portion are formed in the bar member that includes the inner plated part. The connecting portion is formed to join with the external fuel pipe in such a manner that the fuel pipe is securely held by the connecting portion and is fluidly communicated with the branched hole. The sealing portion is formed adjacent to the connecting portion to fluid-tightly engage with the fuel pipe.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF THE INVENTION

Various embodiments of the present invention will be described with reference to the accompanying drawings.

(First Embodiment)

Figure 1:
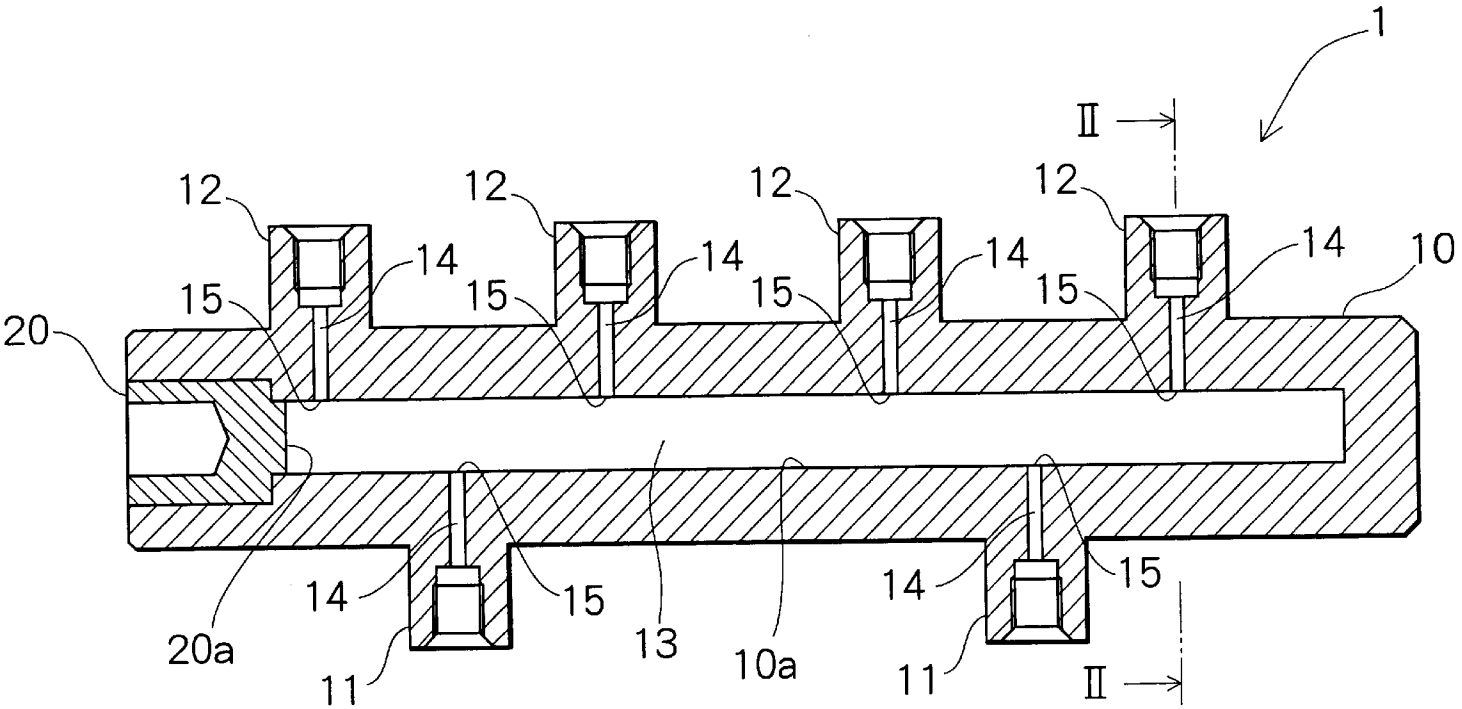
FIG. 1 is a schematic cross sectional view showing a high pressure fuel supply device according to a first embodiment of the present invention.

FIG. 1 shows a high pressure fuel supply device according to a first embodiment of the present invention. The high pressure fuel supply device 1 accumulates high pressure fuel of a predetermined pressure, which is supplied from a high pressure pump (not shown), and supplies the high pressure fuel to injectors (not shown). The high pressure fuel supply device 1 includes a pressure accumulator vessel 10 and a sealing plug 20.

The accumulator vessel 10 includes a plurality of fuel inlets 11 and a plurality of fuel outlets 12. The fuel inlets 11 are connected to the high pressure pump (not shown), and fuel is supplied from the high pressure pump to the fuel inlets 11. The fuel outlets 12 are connected to the corresponding injectors (not shown), and fuel accumulated in the accumulator vessel 10 is discharged to the injectors through the fuel outlets 12.

The accumulator vessel 10 further includes a pressure accumulation chamber 13 and a plurality of fuel passages 14. The accumulation chamber 13 is defined by an inner wall 10*a* of the accumulator vessel 10 and an inner wall 20*a* of an end of the sealing plug 20, which is arranged in an open end of the accumulator vessel 10. The fuel passage 14 is communicated with the accumulation chamber 13 in a radial direction of the accumulator vessel 10. A chamfered section 15 is provided in a connection formed in the inner wall 10*a* of the accumulator vessel 10 between the accumulation chamber 13 and the corresponding fuel passage 14 to reduce concentration of stress in the connection.

Next, the fuel inlets 11 and the fuel outlets 12 will be further described. The fuel inlets 11 and the fuel outlets 12 have substantially the identical structure. Thus, only the fuel outlets 12 will be described below.

Figure 2:
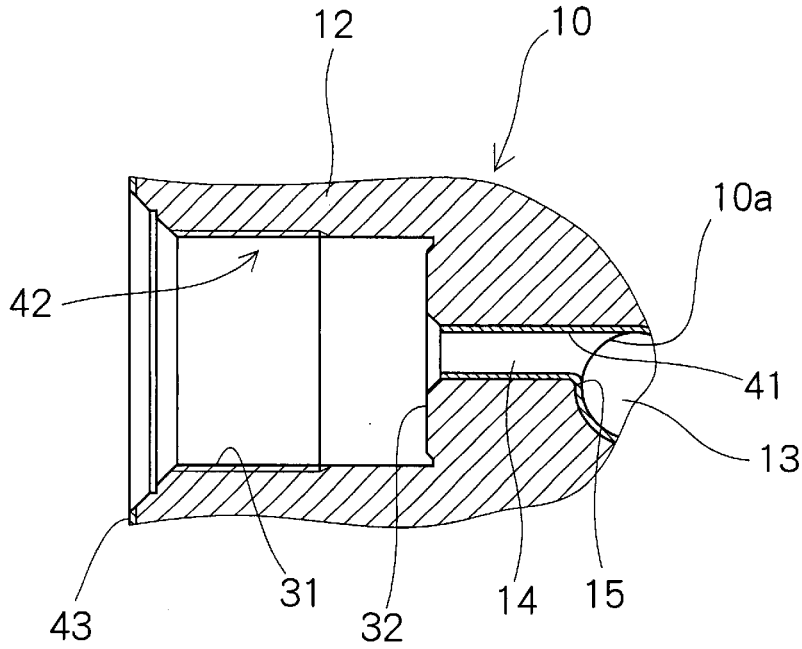
FIG. 2 is an enlarged partial cross sectional view along line II—II in FIG. 1.
Figure 3:
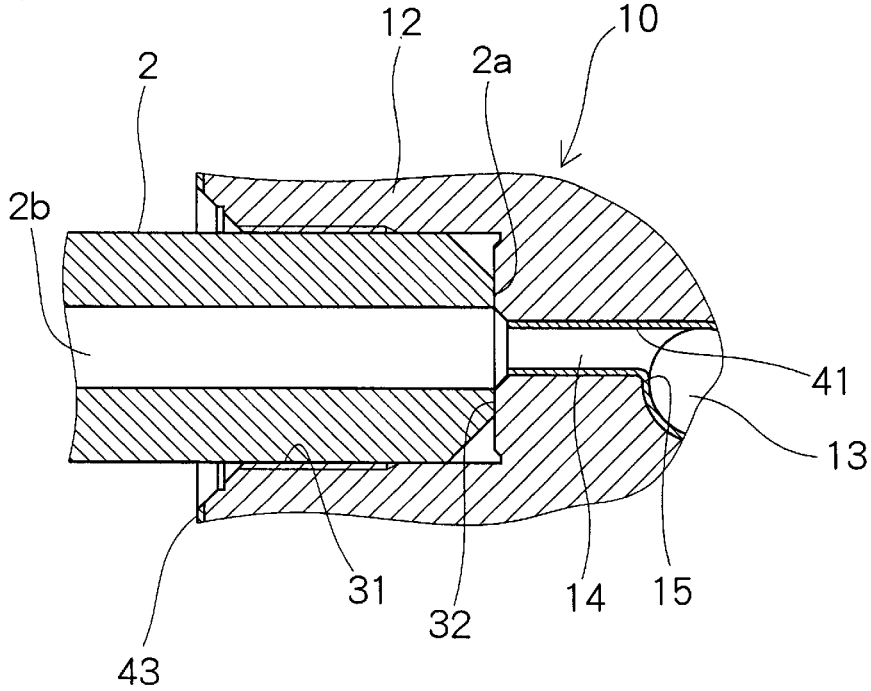
FIG. 3 is an enlarged partial cross sectional view showing a fuel pipe connected to the high pressure fuel supply device of the first embodiment.

As shown in FIG. 2, a connecting portion 31 and a sealing portion 32 are formed in each fuel outlet 12. With reference to FIG. 3, a fuel pipe (also referred to as an external fuel pipe) 2, which is connected to the corresponding injector, is connected to the connecting portion 31. The connecting portion 31 has female threads, which are threadably connected to corresponding male threads of the fuel pipe 2. The sealing portion 32 is smooth and flat and is engageable with an engaging portion 2*a* formed in a distal end of the fuel pipe 2. When the male threads of the fuel pipe 2 are threadably connected to the female threads of the connecting portion 31, and thus the engaging portion 2*a*of the fuel pipe 2 is tightly engaged with the sealing portion 32, the connection between the accumulator vessel 10 and the fuel pipe 2 is fluid-tightly sealed. In this way, a fuel passage 2*b* of each fuel pipe 2 and the corresponding fuel passage 14 are connected to each other. In the case of the fuel inlet 11, a fuel pipe (not shown), which is connected to the high pressure pump, is connected to the connecting portion 31 in a manner similar to that of the fuel outlet 12 described above.

Figure 4:
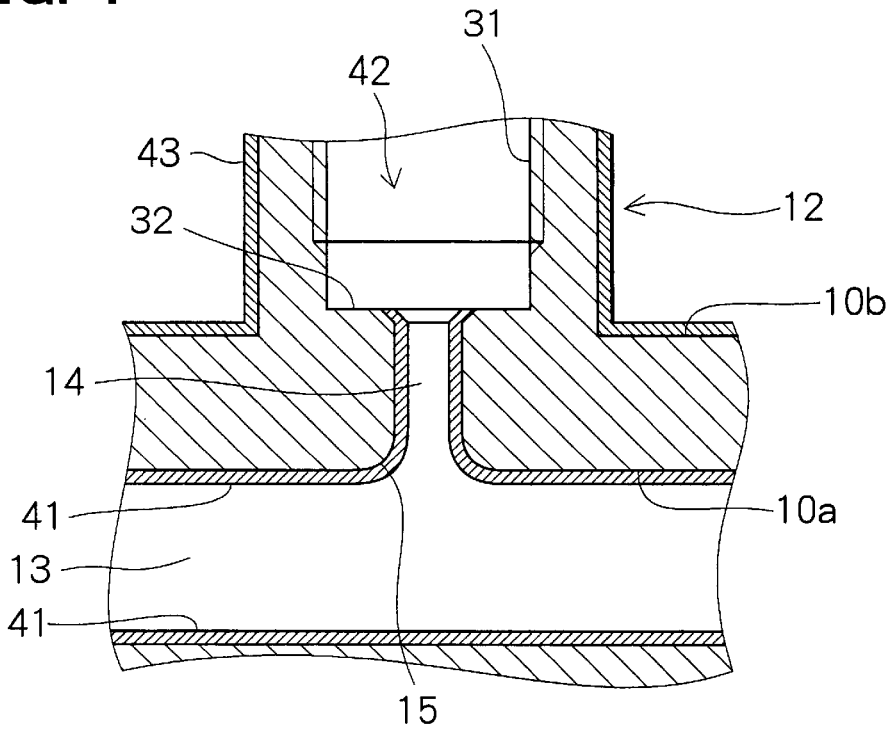
FIG. 4 is an enlarged partial cross sectional view showing a connection between a pressure accumulation chamber and a fuel passage in the high pressure fuel supply device of the first embodiment.

As shown in FIG. 2, the accumulator vessel 10 includes an inner plated part 41 and unplated parts 42. The plated part, 41 is formed in the inner wall 10*a* of the accumulator vessel 10, which forms the accumulation chamber 13 and each fuel passage 14, and is also formed in each chamfered section 15. That is, as shown in FIG. 4, the plated part 41 extends from each fuel passage 14 to the accumulation chamber 13. The plated part 41 includes a metal plating layer, such as a hard chromium plating layer. The plated part 41 is generally uniformly formed in the inner wall 10*a* of the accumulator vessel 10 and in each chamfered section 15. More specifically, the plated part 41 is formed along a wall surface of the accumulation chamber 13, a wall surface of each fuel passage 14 and a wall surface of each chamfered section 15. With reference to FIGS. 1 and 4, each unplated part 42 is formed in the connecting portion 31 and the sealing portion 32 of a corresponding one of the fuel inlets 11 and the fuel outlets 12. Each unplated part 42 is defined as an exposed portion of the inner wall 10*a* of the accumulator vessel 10 where no plating layer is formed.

Figure 5:
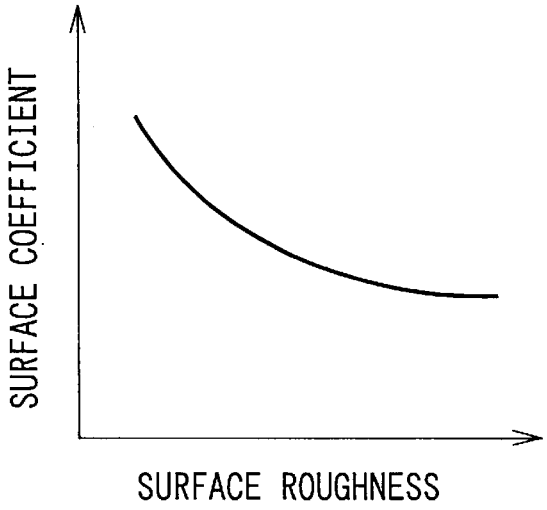
FIG. 5 is a graph showing relationship between surface coefficient and surface roughness.

A thickness of the plating layer of the plated part 41 is preferably equal to or greater than 30 μm due to the following reason. The strength of the accumulator vessel 10 of the high pressure fuel supply device 1 can be expressed, for example, by the following equation:

$$\text{Real Strength}=\text{Surface Coefficient}\times\text{Smooth Material Strength}$$

where the surface coefficient is a coefficient that corresponds to a surface roughness of a portion of the product that has the highest stress in the product, as shown in FIG. 5, and the smooth material strength is the strength of the smooth material that has a smooth surface with no scratches or the like. Based on the relationship between the surface roughness and the surface coefficient, the Rmax (i.e., maximum roughness depth) of the inner wall surface of the accumulator vessel 10 (particularly, the surface of each chamfered section 15) is preferably equal to or less than 6.3 to achieve the satisfactory strength of the accumulator vessel 10 of the high pressure fuel supply device 1. When the processed inner wall surface of the accumulator vessel 10, which is processed, for example, through a cutting process or machining process and thus has the Rz (i.e., ten point average roughness) of about 12.5, is smoothened by applying the plating layer to the processed inner surface to achieve the Rmax of equal to or less than 6.3, the plating layer preferably has a thickness equal to or greater than 30 μm. Here, as the thickness of the plating layer increases, the smoothness of the surface of the corresponding plated part is increased. However, as the thickness of the plating layer increases, the processing time for making the plating layer is accordingly increased. As a result, the practical thickness of the plating layer is determined upon consideration of these two factors, and thus the thickness of the plating layer is normally kept equal to or less than 80 μm.

As described above, each fuel pipe 2 shown in FIG. 3 is threadably connected to the corresponding connecting portion 31. Thus, if the plated part 41 is formed in the connecting portion 31, the plating of the plated part 41 is likely scratched off from the connecting portion 31 at the time of connecting the fuel pipe 2 to the connecting portion 31. When this happens, scratched fragments of the plating can be left in the sealing portion 32 and can cause a reduction in a sealing performance of the sealing between the accumulator vessel 10 and the fuel pipe 2. Furthermore, as described above, the engaging portion 2*a* of each fuel pipe 2 is engaged with the corresponding sealing portion 32. Thus, if the plated part 41 is formed in the sealing portion 32, geometrical accuracy of the sealing portion 32 may be reduced. In such a case, the reduction in the geometrical accuracy of the sealing portion 32 will likely cause a reduction in the sealing performance of the sealing between the accumulator vessel 10 and the fuel pipe 2. Because of the above reasons, the unplated part 42 is provided in the connecting portion 31 and the sealing portion 32.

As shown in FIG. 4, similar to the inner wall 10*a*, an outer plated part 43 is formed in an outer wall 10*b* of the accumulator vessel 10. In order to limit corrosion of the accumulator vessel 10 during manufacturing thereof, a phosphate coating may be formed in the outer wall 10*b* of the accumulator vessel 10. At the time of installing the high pressure fuel supply device 1 in a vehicle, a coating of, for example, lacquer may be formed on the accumulator vessel 10. However, an engine room of the vehicle, in which the high pressure fuel supply device 1 is installed, is likely exposed to wind and rain. Thus, the phosphate coating and the lacquer coating are sometimes not good enough to limit corrosion of the accumulator vessel 10. Because of the above reason, the plated part 41, 43 of the present embodiment is formed not only in the inner wall 10*a* of the accumulator vessel 10 but also in the outer wall 10*b* of the accumulator vessel 10 to more effectively limit corrosion of the accumulator vessel 10. Furthermore, when the plated part 41 is formed in the inner wall 10*a* of the accumulator vessel 10, the plated part 43 can be also simultaneously formed in the outer wall 10*b*. In this way, the number of manufacturing steps is not increased.

Next, manufacturing of the high pressure fuel supply device 1 according to the first embodiment will be described.

Figure 6:
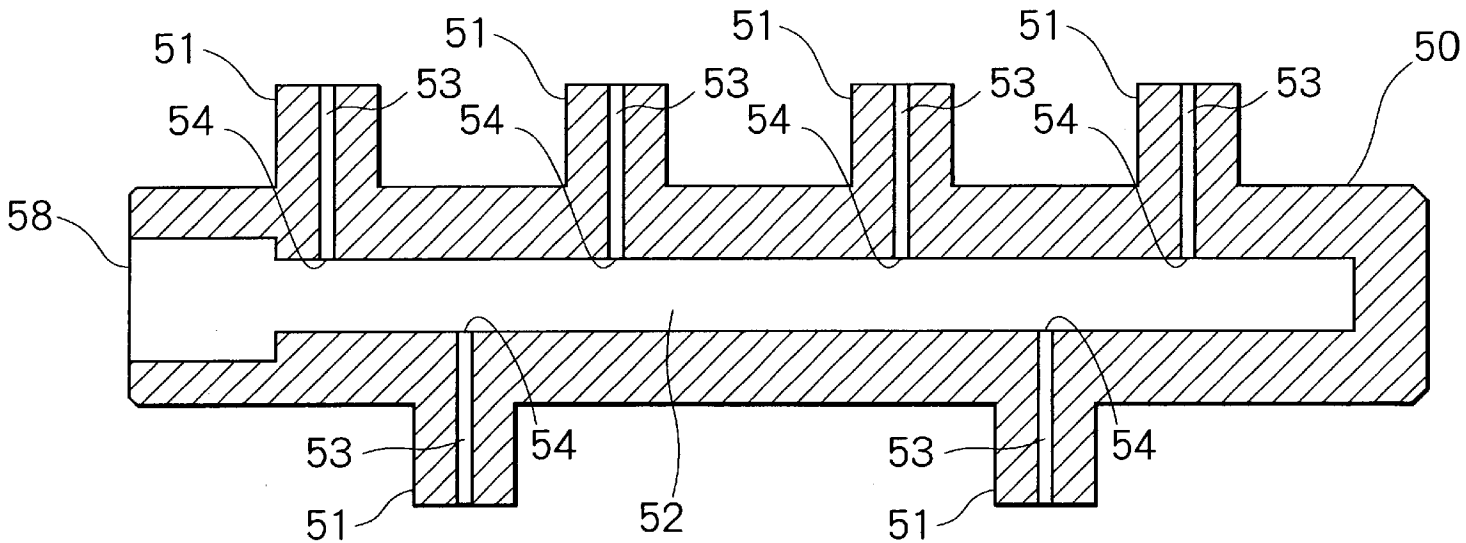
FIG. 6 is a schematic cross sectional view showing an axial hole and branched holes formed in a bar member, showing manufacturing operation of the high pressure fuel supply device of the first embodiment.

As shown in FIG. 6, in a bar member 50, which becomes the accumulator vessel 10, holes, which become the accumulation chamber 13 and the fuel passages 14, respectively, are formed. The bar member 50 is formed through, for example, a casting process. Branched segments 51, which are processed to form the fuel inlets 11 and the fuel outlets 12, respectively, are also formed integrally with the bar member 50. Then, an axial hole 52, which becomes the accumulation chamber 13, and branched holes 53, which are communicated with the axial hole 52 and become the fuel passages 14, are formed in the bar member 50. Each branched hole 53 is formed in the corresponding branched segment 51. The axial hole 52 and the branched holes 53 are formed through, for example, a cutting or machining process.

Figure 7A:
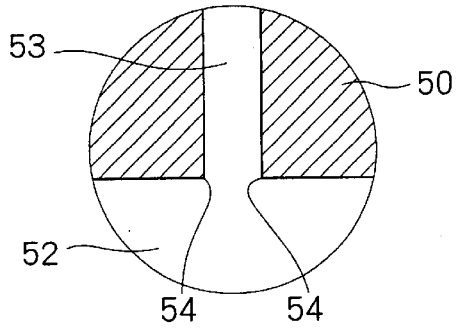
FIG. 7A is a partial enlarged view of FIG. 6 showing an edged corner formed in the connection between the axial hole and the branched hole.
Figure 7B:
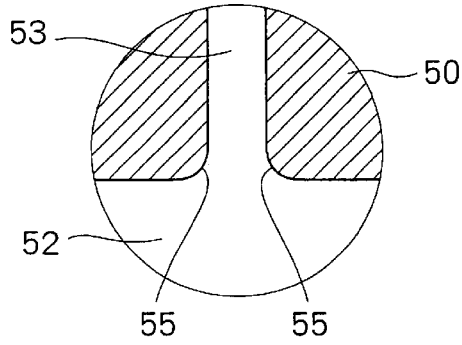
FIG. 7B is a partial enlarged view of FIG. 6 showing a chamfered section formed in the connection between the axial hole and the branched hole.

After the axial hole 52 and the branched holes 53 are formed, an edged corner 54 is formed in a corresponding connection between the axial hole 52 and the corresponding branched hole 53, as shown in FIG. 7A. Since stress is likely concentrated in the corner 54, a chamfered section 55 is formed in each corner 54, as shown in FIG. 7B. The chamfered section 55 is formed to have a curved surface section that has a predetermined radius through, for example, an electrolytic process.

Figure 8:
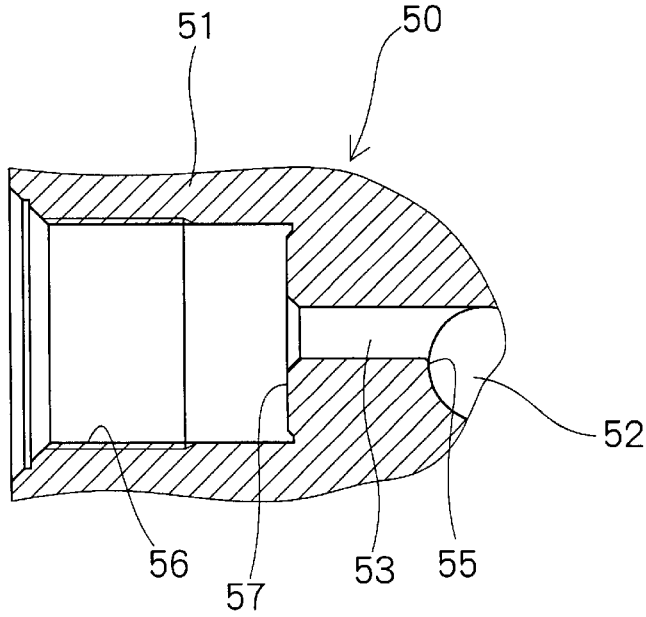
FIG. 8 is an enlarged cross sectional view showing a branched segment, in which a connecting portion and a sealing portion are formed, showing the manufacturing operation of the high pressure fuel supply device of the first embodiment of the present invention.

After the axial hole 52, the branched holes 53 and the chamfered sections 55 are formed in the bar member 50, the connecting portion 56 (corresponding to the connecting portion 31) and the sealing portion 57 (corresponding to the sealing portion 32) are formed in each branched segment 51, as shown in FIG. 8. Here, the connecting portion 56 and the sealing portion 57 are formed through, for example, a cutting process.

Figure 9:
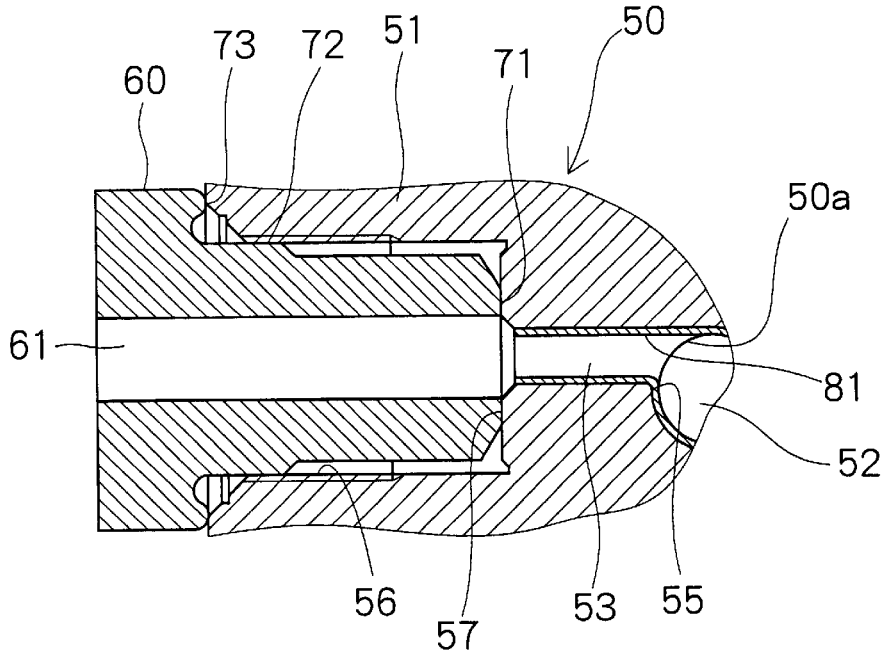
FIG. 9 is an enlarged cross sectional view showing a sealing member installed in the branched segment, depicting the manufacturing operation of the high pressure fuel supply device of the first embodiment.

After the connecting portion 56 and the sealing portion 57 are formed, a removable sealing member 60 is installed in each branched segment 51, as shown in FIG. 9. The sealing member 60 is formed of, for example, a resin material, a rubber material or a mixture thereof. The sealing member 60 is shaped as a hollow cylindrical body, which has a communication passage 61 therein. The sealing member 60 includes first to third engaging portions 71–73. The first engaging portion 71 engages the sealing portion 57. The second engaging portion 72 engages the connecting portion 56. The third engaging portion 73 engages an outer end of the branched segment 51. When the first to third engaging portions 71–73 of the sealing member 60 engage the sealing portion 57, the connecting portion 56 and the end of the branched segment 56, respectively, the sealing portion 57 and the connecting portion 56 are separated from a portion of an inner wall 50*a* of the bar member 50, in which the axial hole 52, the branched holes 53 and the chamfered sections 55 are formed. The sealing member 60 is connected to the corresponding branched segment 51 by press fitting the sealing member 60 into the connecting portion 56 or by threadably connecting the sealing member 60 to the connecting portion 56.

After each sealing member 60 is connected to the corresponding branched segment 51 of the bar member 50, the bar member 50 is soaked in plating solution. The plating solution flows into the bar member 50 through an opening 58 of the axial hole 52 of the bar member 50 shown in FIG. 6 and also through the communication passage 61 of the sealing member 60. In this way, a plated part 81 is formed in the inner wall 50*a* of the bar member 50 except the connecting portions 56 and the sealing portions 57, which are separated from the rest of the inner wall 50*a* by the corresponding sealing members 60. Since the first to third engaging portions 71–73 of the sealing member 60 are engaged with the sealing portion 57, the connecting portion 56 and the end of the branched segment 51, respectively, the plating solution does not enter the sealing portion 57 and the connecting portion 56. Furthermore, when the bar member 50 is soaked in the plating solution, the outer wall of the bar member 50 is plated simultaneously with the inner wall 50*a* of the bar member 50.

Here, the plating layer of the plated part 81 can be formed, for example, by an electrolytic plating process. In the electrolytic plating process, the plating layer tends to be accumulated in each concaved surface point rather than each convex surface point in the rough surface. Thus, as the electrolytic plating process proceeds, the surface is effectively smoothed. If metal impurities are present in plating solution used in the electrolytic plating process, the metal impurities tend to be accumulated in the plated surface and make the surface sandy. In order to restrain this, the metal impurities in the plating solution can be removed by, for example, a corresponding device to make the surface smoother.

With the above-described process, the plated part 81 is formed in both the inner wall 50*a* and the outer wall of the bar member 50, and each unplated part is formed in the corresponding connecting portion 56 and sealing portion 57. After the bar member 50 is removed from the plating solution, each sealing member 60 is removed from the bar member 50, so that the accumulator vessel 10 shown in FIGS. 1 to 4 is produced. The sealing plug 20 is press fitted into or is threadably connected to the accumulator vessel 10 to form the high pressure fuel supply device 1.

As described above, the plated part 41 is formed in the accumulator vessel 10 of the high pressure fuel supply device 1 of the first embodiment of the present invention after formation of each chamfered section 15. Thus, a surface of the portion of the inner wall 10*a* of the accumulator vessel 10, in which the accumulation chamber 13, the fuel passages 14 and the chamfered sections 15 are formed, is smoothed by the plated part 41. In the above arrangement, without increasing the number of components, concentration of stress in the accumulator vessel 10 is reduced or minimized, and durability of the accumulator vessel 10 is improved. Furthermore, since the surface of the inner wall 10*a* of the accumulator vessel 10 is smoothed by the plated part 41 as described above, it is not required to provide an additional process, such as an abrasive flow machining process, after formation of the chamfered sections 15. Therefore, the surface of the inner wall 10*a* is substantially free of residual debris, such as abrasive grains left after the abrasive flow machining process. In addition, residual debris, which has adhered to the inner wall 10*a* of the accumulator vessel 10 before the formation of the plated part 41, is covered with the plating of the plated part 41. Thus, the amount of residual debris in the accumulator vessel 10 can be reduced. Furthermore, the formation of the unplated part 42 in the corresponding connecting portion 31 and the sealing portion 32 can prevent generation of debris, which could be formed upon scratching of plating, and a reduction in the sealing performance of the sealing, so that fuel leakage from the connection between the accumulator vessel 10 and the fuel pipe 2 can be restrained. As a result, reliability of the high pressure fuel supply device 1 can be advantageously improved.

In the first embodiment, the formation of the plated part 41 results in the smoothing of the inner wall 10*a* of the accumulator vessel 10. Thus, the abrasive flow machining process, which requires a relatively long processing time, and a washing process, which is performed after the abrasive flow machining process, are not required. As a result, the number of manufacturing steps and the total manufacturing time can be advantageously reduced.

Furthermore, in the first embodiment, the plated part 43 is formed in the outer wall 10*b* of the accumulator vessel 10. Thus, corrosion of the accumulator vessel 10 can be advantageously limited to increase the lifetime of the high pressure fuel supply device 1. Also, the formation of the plated part 43 in the outer wall 10*b* of the accumulator vessel 10 can be simultaneously performed with the formation of the plated part 41 in the inner wall 10*b*, so that there is no increase in the number of the manufacturing steps or the total manufacturing time.

(Second Embodiment)

A high pressure fuel supply device according to a second embodiment of the present invention will be described. The second embodiment differs from the first embodiment in the manufacturing operation of the high pressure fuel supply device. However, the manufactured high pressure fuel supply device of the second embodiment is substantially the same as that of the first embodiment.

As shown in FIG. 6, which is described with reference to the first embodiment, the axial hole 52, which becomes the accumulation chamber 13, and the branched holes 53, which become the fuel passages, are formed in the bar member 50. The branched segments 51, which become the fuel inlets 11 and the fuel outlets 12, are formed integrally with the bar member 50. Furthermore, each chamfered section 52 is formed in the connection between the axial hole 52 and the corresponding branched hole 53.

Figure 10:
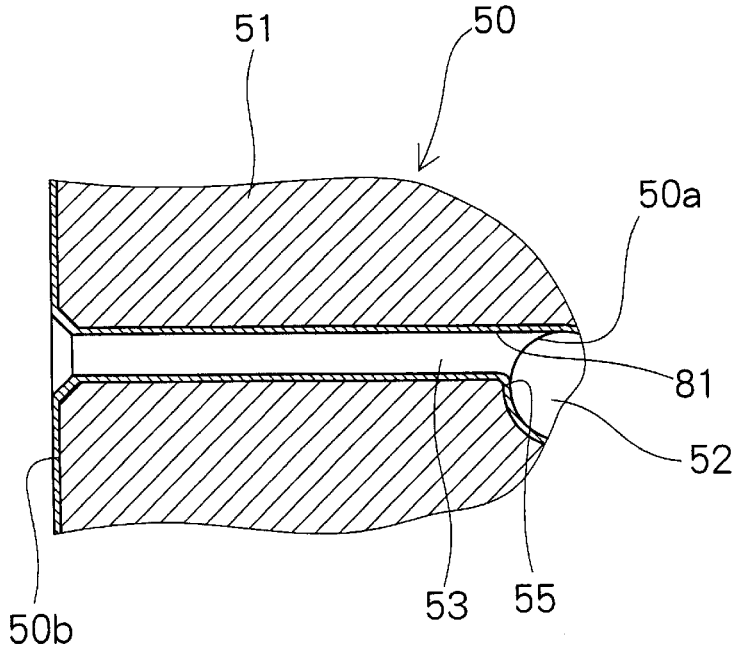
FIG. 10 is an enlarged cross sectional view showing a plated segment on an inner wall and an outer wall of the bar member, depicting manufacturing operation of a high pressure fuel supply device according to a second embodiment of the present invention.

After the axial hole 52, the branched holes 53 and the chamfered sections 55 are formed in the bar member 50, the bar member 50 is soaked in the plating solution. In this way, the plated part 81 is formed in each of the inner wall 50*a* and the outer wall 50*b* of the bar member 50, as shown in FIG. 10.

In the bar member 50, in which the plated part 81 is formed, each connecting portion and each sealing portion are formed in the corresponding branched segment 51. The connecting portion and the sealing portion are formed by enlarging an inner diameter of the branched hole 53 of the corresponding branched segment 51. Here, the connecting portion and the sealing portion are formed through, for example, a cutting process or machining process. Thus, a portion of the plated part 81 in each branched hole 53 is removed, so that the connecting portion and the sealing portion become an unplated part, in which no plating is provided. As a result, each branched segment 51, in which the connecting portion and the sealing portion are formed, has a shape that is substantially the same as that of, for example, the fuel outlet of the first embodiment shown in FIG. 2.

After the connecting portions and the sealing portions are formed in the bar member 50, the bar member 50 is washed to remove debris generated through the formation of the connecting portions and the sealing portions. The debris generated through the formation of the connecting portions and the sealing portions can be easily removed through a simple washing process, so that a long time washing process is not required.

Upon completion of the above processes, the accumulator vessel 10 is produced. Then, the sealing plug 20 is connected to the accumulator vessel 10 by press fitting of the sealing plug 20 into the accumulator vessel 10 or by threadably connecting the sealing plug 20 to the accumulator vessel 10. As a result, the high pressure fuel supply device 1 is produced.

In the second embodiment, the plated part 81 is formed in the bar member 50 before formation of the connecting portions and the sealing portions. The formation of the connecting portions and the sealing portions in the bar member 50, in which the plated part 81 is formed, allows elimination of the installation process for installing each sealing member 60 to the bar member 50. Thus, the manufacturing of the accumulator vessel 10 is eased. Furthermore, even in the case where the connecting portions and the sealing portions are formed in the bar member 50 after the formation of the plated part 81, removal of the debris is easy. Thus, complication and elongation of the manufacturing operation can be advantageously avoided. As a result, the total manufacturing time of the accumulator vessel 10 can be reduced.

In each of the above-described embodiments, there has been described the procedure of forming the connecting portions and the sealing portions in the bar member, which becomes the accumulator vessel, after the chamfered sections are formed in the bar member. Alternatively, the chamfered sections can be formed in the bar member after the axial hole, the branched holes, connecting portions and the sealing portions are formed in the bar member.

Additional advantages and modifications will readily occur to those skilled in the art. The invention in its broader terms is therefore not limited to the specific details, representative apparatus, and illustrative examples shown and described.

What is claimed is:

1. A high pressure fuel supply device comprising a pressure accumulator vessel that includes:

a pressure accumulation chamber that extends in an axial direction of the pressure accumulator vessel;

a fuel passage that fluidly communicates between the accumulation chamber and an outside of the pressure accumulator vessel; and a chamfered section that is formed in a connection between the accumulation chamber and the fuel passage, wherein an inner plated part, which includes a plating layer, is formed along a wall surface of the accumulation chamber, a wall surface of the fuel passage and a wall surface of the chamfered section, and the pressure accumulator vessel further includes:

a connecting portion that is formed to join with an external fuel pipe in such a manner that the fuel pipe is securely held by the connecting portion and is fluidly communicated with the fuel passage; and a sealing portion that is formed adjacent the connecting portion to fluid-tightly engage with the fuel pipe, wherein an unplated part is formed along a wall surface of the connecting portion and a wall surface of the sealing portion.

2. A high pressure fuel supply device according to claim 1, wherein the pressure accumulator vessel further includes an outer plated part that includes a plating layer and is formed along an outer wall surface of the accumulator vessel.

3. A high pressure fuel supply device according to claim 1, wherein the plating layer of each plated part includes a hard chromium plating layer.

4. A high pressure fuel supply device according to claim 1, wherein a thickness of the plating layer of each plated part is equal to or greater than 30 $\mu$m.

5. A manufacturing method of a high pressure fuel supply device, to which an external fuel pipe is joined, the method comprising:

forming an axial hole, a branched hole and a chamfered section in a bar member, wherein:

the axial hole extends in an axial direction of the bar member;

the branched hole fluidly communicates between the axial hole and an outside of the bar member; and the chamfered section is formed in a connection between the axial hole and the branched hole;

forming a connecting portion and a sealing portion in the bar member, wherein:

the connecting portion is formed to join with the external fuel pipe in such a manner that the fuel pipe is securely held by the connecting portion and is fluidly communicated with the branched hole; and the sealing portion is formed adjacent to the connecting portion to fluid-tightly engage with the fuel pipe;

installing a removable sealing member in the bar member in such a manner that the sealing member engages the connecting portion and the sealing portion to fluid-tightly separate the axial hole and the branched hole from the connecting portion and the sealing portion; and forming a plated part, which includes a plating layer, along a wall surface of the axial hole, a wall surface of the branched hole and a wall surface of the chamfered section.

6. A manufacturing method according to claim 5, wherein the forming of the plated part including forming the plated part along an outer wall surface of the bar member when the plated part is formed along the wall surface of the axial hole, the wall surface of the branched hole and the wall surface of the chamfered section.

7. A manufacturing method according to claim 6, wherein the forming of the plated part including soaking of the bar member in plating solution.

8. A manufacturing method of a high pressure fuel supply device, to which an external fuel pipe is joined, the method comprising:

forming an axial hole, a branched hole and a chamfered section in a bar member, wherein:

the axial hole extends in an axial direction of the bar member;

the branched hole fluidly communicates between the axial hole and an outside of the bar member; and the chamfered section is formed in a connection between the axial hole and the branched hole;

forming a plated part, which includes a plating layer, along a wall surface of the axial hole, a wall surface of the branched hole and a wall surface of the chamfered section;

forming a connecting portion and a sealing portion in the bar member that includes the plated part, wherein:

the connecting portion is formed to join with the external fuel pipe in such a manner that the fuel pipe is securely held by the connecting portion and is fluidly communicated with the branched hole; and the sealing portion is formed adjacent to the connecting portion to fluid-tightly engage with the fuel pipe; and forming an unplated part along a wall surface of the connecting portion and a wall surface of the sealing portion.

9. A manufacturing method according to claim 8, further comprising washing the branched hole and the axial hole after the forming of the connecting portion and the sealing portion.

10. A manufacturing method according to claim 5, wherein the forming of the plated part includes forming a plating layer that is a hard chromium plating layer.

11. A manufacturing method according to claim 5, wherein the forming of the plated part including forming a plating layer on each plated part to equal to or greater than 30 $\mu$m.

12. A manufacturing method according to claim 8, wherein the forming of the plated part includes forming a plating layer that is a hard chromium plating layer.

13. A manufacturing method according to claim 8, wherein the forming of the plated part including forming a plating layer on each plated part to equal to or greater than 30 $\mu$m.

14. A manufacturing method according to claim 5, further comprising, after the forming of the plated part, removing the removable sealing member.

15. A manufacturing method according to claim 14, comprising, after said removing, joining the connecting portion with the external fuel pipe in such a manner that the fuel pipe is securely held by the connecting portion, the sealing portion fluid-tightly engages the fuel pipe, and the fuel pipe is fluidly communicated with the branched hole.

* * * * *